United States Patent [19]

Tunstull et al.

[11] 4,149,632

[45] Apr. 17, 1979

[54] RECORD ALBUM AND MOBILE

[75] Inventors: Glenn Tunstull; Toyce Anderson, both of New York, N.Y.

[73] Assignee: Toyce-Glenn, Inc., New York, N.Y.

[21] Appl. No.: 898,423

[22] Filed: Apr. 20, 1978

[51] Int. Cl.[2] ..... G09F 1/10; B65D 65/28; B65D 77/08

[52] U.S. Cl. ..... 206/216; 40/617; 46/32

[58] Field of Search ..... 40/617; 46/32; 206/216, 206/223, 311-312

[56] References Cited

U.S. PATENT DOCUMENTS

| | | | |
|---|---|---|---|
| 2,490,230 | 12/1949 | Riegel | 46/32 |
| 2,636,312 | 4/1953 | Martin | 206/216 X |
| 2,742,147 | 4/1956 | Ledel | 206/216 |
| 3,303,603 | 2/1967 | Abeson | 206/216 X |
| 3,676,942 | 7/1972 | Elrod | 40/617 X |
| 4,055,690 | 10/1977 | Patterson | 40/617 X |

*Primary Examiner*—Davis T. Moorhead
*Attorney, Agent, or Firm*—Kane, Dalsimer, Kane, Sullivan & Kurucz

[57] ABSTRACT

A combination record album and mobile which includes a jacket for protecting a phonograph record removably insertable therein. The jacket has a plurality of strings extending from one surface thereof for mounting the jacket to a fixed support structure. A predetermined number of mobile figures are mounted on strings extending from the jacket so that the figures can be shifted between a first position in close proximity to the jacket and a second position suspended from the jacket for limited movement.

7 Claims, 3 Drawing Figures

RECORD ALBUM AND MOBILE

BACKGROUND OF THE INVENTION

In modern discotheque enviroment as well as in modern home decorating, it is common practice to employ the uses of mobiles for decorative purposes. Mobiles are mounted on walls, suspended from ceilings or placed at similar elevated locations for aesthetic value.

It is also conventional in the music field and has been for many years to employ a somewhat rigid rectangular carboard-like jacket or album to hold and protect a phonograph record when it is not in use. The albums in themselves are decorative in that they are often aesthetically designed for attracting a consumer and for providing a pleasing exterior appearance. This is true in regard to public as well as private locations where music is enjoyed and phonograph recordings are employed.

The functional use of an album is to protect a record during handling and storage and the functional use of a mobile is for decoration. It would certainly be desirable to combine the attributes of both in regard to certain types of recordings and artistic reditions with the decorative aspects of the album and the mobiles tied to the music for the improved enjoyment of the listener and observer.

SUMMARY OF THE INVENTION

With the above background in mind, it is among the primary objectives of the present invention to provide a combined mobile and record album structure wherein the aesthetic values of the album and the mobile are retained and the storage capabilities of the album for protecting a phonograph record and housing mobile figures when not in use is also obtained. In this manner, a multiple function structure is provided.

The structure is unitary in nature and includes projecting strings or wires to facilitate mounting of the album to a ceiling and, alternatively, could include mounting structure for mounting the album to a wall. Mobile figures can be suspended from strings on the album so that they have limited free movement for maximum aesthetic value. Strings or wires form the attachment between the album or record jacket and the mobile figures as well as between the record jacket and the supporting surface.

The jacket of the album is designed to include a pocket for reception of the phonograph record and, can receive the mobile figures therein when not in use. Alternatively, the figures can be mounted on the exterior surface of the jacket by appropriate adhesive means or by the use of exterior pockets. Naturally the jacket can be of the conventional rectangular flat configuration or can be formed in other shapes like a polyagon or a disk.

It is contemplated that the figures suspended from the jacket can be designed in the desired manner to coordinate their aesthetic appearance with the location and with the music. Naturally other means of attachment between the jacket and the supporting structure and mobile figures can be utilized as long as the necessary mobile movement is achieved as well as the necessary support.

In summary, a combination record album and mobile is provided including a jacket for protecting a phonograph record removably insertable therein. Means is on the jacket for supporting a predetermined number of mobile figures shiftable between a first position in close proximity to the jacket and a second position suspended from the jacket for limited movement. Means is provided for mounting the jacket to an elevated support structure.

With the above objectives among others in mind, reference is made to the attached drawings.

DETAILED DESCRIPTION

Figure 1:
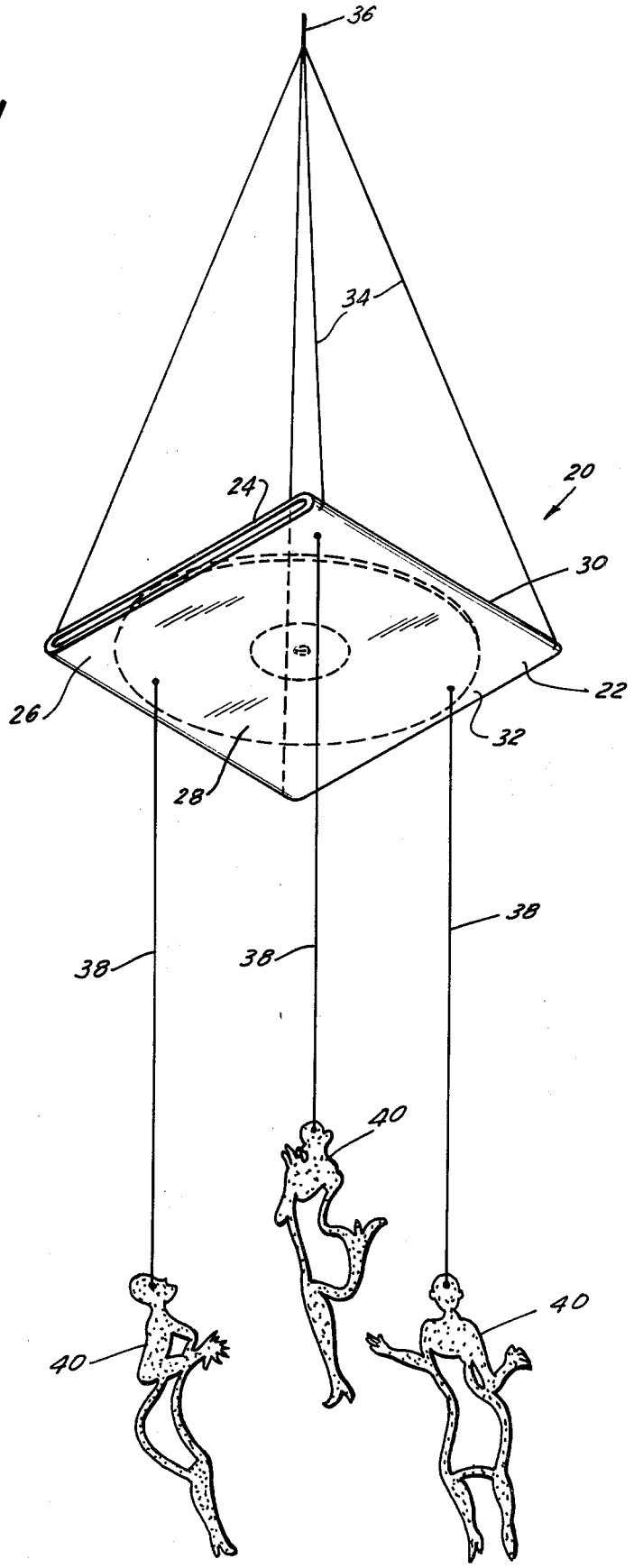
FIG. 1 is a perspective view of the combination record album and mobile of the invention in suspended condition.

A record album and mobile combination 20 is depicted in suspended operable form in FIG. 1. The album portion is in the form of a record jacket 22 which has the conventional rectangular flat configuration with an opening 24 in one edge to form an entry to an interior pocket 26 for housing a conventional phonograph record 28.

The album has an enlarged flat upper surface 30 and an enlarged flat lower surface 32. Appropriate decorative designs can be applied in conventional manner to the upper and lower surfaces of the jacket.

An arrangement of four spaced strings 34 are affixed to the upper side 30 of the record jacket. The strings 34 form a means for suspending the album and mobile from a ceiling. The ends of each string 34 distal from the record jacket 22 are joined at a common point 36 and are mountable in conventional fashion such as by a thumbtack or tying to a hook on the ceiling. The other end of each string 34 is attached to a predetermined point on record jacket 22. This is also accomplished in a conventional fashion such as by appropriate clips and the like. The strings are spaced on the peripheral surface of the jacket 22 such as adjacent to the four rectangular corners as shown in FIG. 1 to balance the suspension of the jacket. In this manner, the jacket can be hung at the desired angle with respect to the ceiling such as horizontal and parallel to the ceiling surface.

Extending from the lower surface 32 of the jacket it is an arrangement of strings 38 which can be attached in a similar conventional fashion to the jacket as strings 34 are spaced on the undersurface 32 of the jacket in a predetermined preselected pattern.

Each string 38 hangs downward and is attached at its free end to a mobile figure 40. The figures 40 are designed to have an aesthetic appearance and to have limited suspended movement as they hang from jacket 22, the ceiling, and from string 38. They are spaced so that they have relatively free movement with respect to one another and they can hang at various distances below the album as shown in FIG. 1. In addition to the aesthetic appearance of the mobile figures 40, they can be coordinated with the designs of the jacket exterior and with the music on the phonograph record within the album or with any related artistic environment in which the mobile is to be employed.

Figure 2:
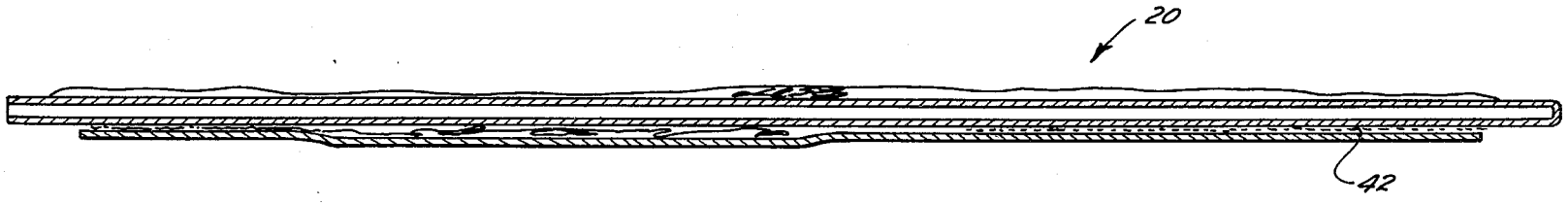
FIG. 2 is a cross sectional view thereof in closed condition.

When the mobile is not in use, it can be reduced to a compact inexpensive package. The record 28 is retained in pocket 26 and the hanging strings 34 can be attached to the upper surface 30 of the jacket 22 in any conventional fashion such as by an appropriate adhesive or other conventional inexpensive fastening means. Similarly, on the lower surface 32 of the jacket, the mobile figures 40 can be attached in a conventional manner by a typical well known dry mount adhesive 42 as shown in FIG. 2 or by clips and the like. Naturally the attachment of the mobile strings, as shown, is coordinated with the attachment of the mobiles. In FIG. 2 the strings are captured between the mobile and the lower surface 32 of the jacket 22. With the mobile figures 40 mounted in this manner on the external surface of the record jacket, they can once again be coordinated with the exterior jacket design to enhance the aesthetic and commercial appearance of the combination record album and mobile.

In use, it is merely necessary to detach the strings 34 from the upper surface 30 of the album jacket 22 and affix the strings 34 at their common point 36 to the ceiling. The mobile figures 40 can then be detached from lower surface 32 and through the use of their attachment means in the form of strings 38 hang suspended from the jacket which in turn is suspended from the ceiling. In this manner, the mobile is quickly and easily changed to an active usable condition. For use of record 28, it is removed from the record from the album jacket 22 either before or after suspension. The record can be stored within pocket 26 of the jacket while the mobile is in use and naturally when other music is being played.

Figure 3:
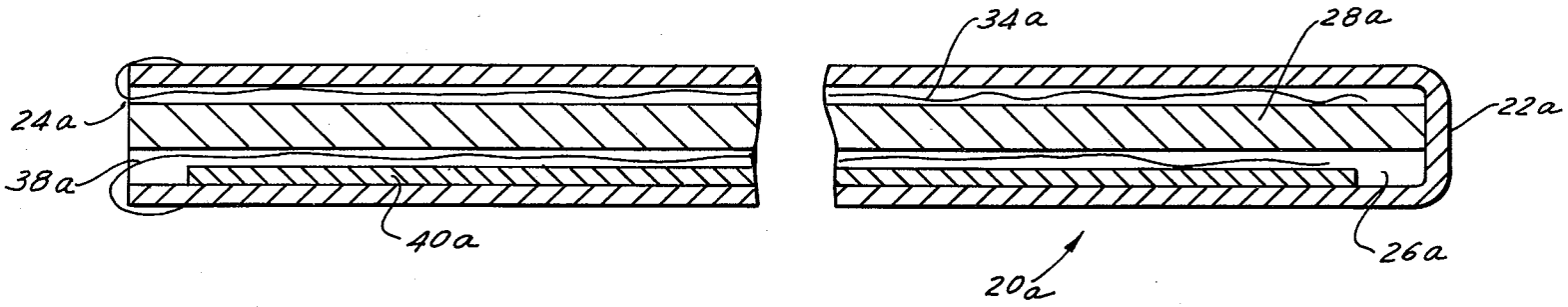
FIG. 3 is a fragmentary sectional view of an alternative ambodiment thereof in closed condition.

There are many alternatives forms of the combination structure of the present invention. One such form is depicted in FIG. 3 where like parts bear the same numeral with the addition of the subscript a added thereto. In record album and mobile 20*a*, the mobile Figs. 40*a* and attachment strings 38*a* are mounted on the interior of the jacket 22*a* instead of the exterior surface thereof. Similarly, the hanging strings 34*a* are also stored interiorally of jacket 22*a* in pocket 26*a* along with phonograph record 28*a*. All of the mobile elements including strings and mobile figures are removable along with phonograph record 28*a* through edge opening 24*a* of the album. In use, the embodiment of FIG. 3, when in hanging form, is identical to that of the embodiment of FIGS. 1 and 2.

Other alternatives which are contemplated but are not shown, include the employment of pockets on the exterior surface of the album to house the strings and mobile figures, and alterations in configuration of the mobile figures and the jacket. In fact the jacket may be disk-shaped or take another polyagonal form. Additionally, it is possible to utilize different hanging means and suspension means in place of strings 34 and 38 respectively. In place of strings, wires, plastic strips or even larger or more rigid suspension structures can be employed. All that is necessary is that the necessary freedom in suspension be retained as well as the ability to store and house the mobile in the flat and collapsed form as depicted in FIGS. 2 and 3 when not is use. Furthermore, in addition to mounting of the mobile on a ceiling as shown, it is contemplated that the mobile can be adapted for wall mounting with appropriate fastening means provided for the wall and suspension means for the mobile so that the necessary freedom of movement for aesthetic appearance can be achieved for the album and mobile figures.

Naturally an overall objective of the present invention in addition to the aesthetic and artistic value of the combined structure is to provide one which is of low cost and adaptable for mass production. The ability to contain the multiple functions of the record album and the mobile within a single structure naturally is of great assistance in achieving this objective.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

We claim:

1. A combination record album and mobile comprising; a jacket for projecting a phonograph record removably insertable therein, means on said jacket for supporting a predetermined number of mobile figures shiftable between a first position in close proximity to the jacket and a second position suspended from the jacket for limited movement, means for mounting the jacket to an elevated support structure, an open pocket in the jacket for receipt and removal of a phonograph record, the mobile figures extending from suspenders with the suspenders being mounted on the jacket, at least one mobile figure attached to the end of each suspender opposite to the end of the suspender attached to the jacket, each suspender permitting limited movement of each mobile figure attached thereto with respect to the jacket, storage means on the jacket to receive the mobile figures when moved to the first position and to permit removal of the mobile figures for shifting to the second position suspended from the jacket, and the means for mounting the jacket to an elevated support structure including at least one suspender having one end affixed to the jacket and the other end to the support structure so that the jacket and mobile figures can be hung therefrom.

2. The invention in accordance with claim 1 wherein the jacket is rectangular in configuration, the pocket in the jacket being open at one end thereof, the mobile figures being suspended from strings spaced and mounted in fixed position on one enlarged surface face of the jacket.

3. The invention in accordance with claim 1 wherein the suspenders permit the mobile figures to be removably inserted in the pocket formed on the interior of the record jacket.

4. The invention in accordance with claim 1 wherein the suspenders are of a predetermined length to permit the figures to be shifted from a suspended position to a position in which they are removably mounted on the exterior surface of the jacket.

5. The invention in accordance with claim 4 wherein the mobile figures are removably mountable in pockets formed on the exterior surface of the jacket.

6. The invention in accordance with claim 1 wherein the means for mounting the jacket to an elevated support structure includes a plurality of suspenders with each suspender having one end affixed to the jacket and a free end in position to be mounted to the support structure so that the jacket and mobile figures can be suspended therefrom, and the support structure being an overhead surface.

7. The invention in accordance with claim 1 wherein the jacket has an upper surface and a lower surface and a pocket therein between the upper and lower surfaces, an opening in the edge of the jacket between the upward and lower surfaces for removably inserting a record album in the pocket, the mobile figures being suspended from the lower surface of the jacket and the means for mounting the jacket to an elevated support structure being mounted on the upper surface of the jacket so that the combination of jacket and mobile figure is adaptable to be mounted to an overhead surface with the jacket and mobile figures suspended downwardly therefrom and the mobile figures shiftable into and out of the first and second positions.

* * * * *